United States Patent [19]

Carter et al.

[11] 4,182,107

[45] Jan. 8, 1980

[54] METHOD OF FORMING S-Z TWISTED STRAND UNITS

[75] Inventors: Joe M. Carter, Lawrenceville; Clyde J. Lever, Jr., Norcross; Gerald A. Scheidt, Atlanta, all of Ga.

[73] Assignee: Western Electric Company, Inc., New York, N.Y.

[21] Appl. No.: 957,772

[22] Filed: Nov. 6, 1978

[51] Int. Cl.[2] ..... H01B 13/04

[52] U.S. Cl. ..... 57/293

[58] Field of Search ..... 57/293, 294, 204, 205, 57/345, 346

[56] References Cited

U.S. PATENT DOCUMENTS

| | | | |
|---|---|---|---|
| 2,655,781 | 10/1953 | Heberlein et al. | 57/346 |
| 3,052,079 | 9/1962 | Henning | 57/293 |
| 3,373,550 | 3/1968 | Symonds | 57/294 |
| 3,507,108 | 4/1970 | Yoshimura et al. | 57/294 |
| 3,593,509 | 7/1971 | Feese et al. | 57/293 |
| 3,643,411 | 2/1972 | Vogelsberg | 57/294 |
| 3,782,092 | 1/1974 | Vogelsberg | 57/294 |
| 3,808,787 | 5/1974 | Vogelsberg | 57/294 |
| 3,823,536 | 7/1974 | Vogelsberg et al. | 57/294 |
| 3,941,166 | 3/1976 | Maillefer | 57/293 X |
| 4,006,582 | 2/1977 | Gurkaynak et al. | 57/294 |
| 4,056,925 | 11/1977 | Vogelsberg | 57/293 |

OTHER PUBLICATIONS

"Forming Alternate Reverse Twists in a Continuously Advancing Wire Paire"; Hutchinson et al.; Western Electric Technical Digest, No. 23; pp. 33 & 34; Jul. 1971.

*Primary Examiner*—John Petrakes
*Attorney, Agent, or Firm*—Robert B. Kennedy

[57] ABSTRACT

A method is disclosed for forming strands into twisted strand units having a twist direction that reverses from section to section wherein the strands are advanced side-by-side successively through first and second mutually spaced twister heads. The strands are formed into twisted strand units by the steps of operating the twister heads simultaneously by revolving the twister heads in a common rotary direction about the strands at substantially the same speed of head revolution thereby causing a first progression of twists of one lay direction to pass from the first twister head towards the second twister head, and a second progression of twists of opposite direction lay to emanate from the second twister head. Twisting operations by the first and second twister heads are simultaneously terminated as the leading end of the first progression of twists reaches the second twister head and a trailing end of the second progressing of twists emanating therefore. Twisting operations of the first and second twister heads are then suspended until a trailing end of the first progression of twists reaches the second twister head whereupon the foregoing steps are repeated.

8 Claims, 10 Drawing Figures

METHOD OF FORMING S-Z TWISTED STRAND UNITS

FIELD OF THE INVENTION

This invention relates to methods of forming strands into twisted strand units having a twist direction that reverses from section to section.

BACKGROUND OF THE INVENTION

In conventionally producing twisted strands of insulated conductors or cables either the strand supply or strand takeup has been retated about the axis of the strands to impart a unidirectional twist. More recently, methods and apparatuses have been devised for forming twisted strand units without the need for revolving the strand supply or takeup by the procedure of reversing the direction of twistlay from section to section. This has become known as S-Z type twisted with S referring to left-hand twists and Z referring to right-hand twists. It is usually performed with mutually spaced twister heads referred to as an accumulator.

The previous methods of forming S-Z twisted strand units such as strand pairs and quads may be placed into select categories. In one category the speed of linear advance of the strands and the speed of revolution of the mutually spaced twister heads about the strands are both maintained constant while the spacing occupied by the strands between the twisting heads is varied. This may be done by reciprocal movement of a twister head located between the two other twister heads which provides a twist accumulator of variable storage capacity that has become known as a breathing accumulator. Examples of S-Z twisting methods employing such variable storage accumulators are shown in U.S. Pat. Nos. 3,373,550 and 3,782,092.

Another method of forming S-Z twisted strand units is performed with a device that is known as a variable capacity, in-line accumulator, an example which is shown in U.S. Pat. No. 3,052,079. With this type of accumulator the twisting heads are moved in unison up and down an advancing line of strands while the speed of advance of the strands and the speed of revolution of the twister heads thereabout are both maintained constant.

A third category of methods used in forming S-Z twisted strand units employs a fixed storage type accumulator which effects S-Z twisting by varying the advance speed of the strands through the accumulator while maintaining the speed of revolution of the accumulator twisting heads constant about the strands. An example of this approach is shown in U.S. Pat. No. 3,507,108. A fourth category of methods for forming S-Z twists also utilizes an accumulator of fixed storage content type but which varies the relative speed of rotation of the twister heads themselves while maintaining the linear speed of advance of the strands constant. This category is represented by U.S. Pat. Nos. 3,823,536 and 4,006,582.

The just described methods of forming S-Z twisted strand units have been characterized by various individual attributes and limitations. For example, though use of the variable capacity, in-line accumulator is made without altering strand advance speed, it has not proven to be practical in operation due to the need for moving the entire accumulator itself up and down the line of strand advance in performing twister operations. The breathing accumulator has met a larger degree of success attributable in part to the fact that it is a relatively compact system that operates at low traverse speeds. The breathing accumulator however is relatively complex and limits strand advance speed which can only be alleviated by operating the breathing accumulator itself at such speed that it exerts an unacceptable high degree of tension on the strands. With those storage accumulators of the type that employ a variable line speed it is necessary either to accept such line speed variations, which usually interfers adversely with other manufacturing operations being formed on the strands in tandem with the twisting operation, or to employ external accumulators between such other in tandem operations and the twisting operation in order to provide a fixed advance speed through the other manufacturing stations.

Still other problems are encountered with fixed storage accumulators of the type capable of maintaining a constant line speed and which effect S-Z strand twisting by varying the relative speed of revolution of the accumulator twisting heads. Foremost among these is the fact that by varying the relative speeds of the twisting heads twists initially formed in the strands are later untwisted by the downstream head to some extent. This tends to work harden metallic strands rendering them less flexible and also leads to the development of twist nonuniformities due to the inherent difficulty in controlling the untwisting of previously twisted strands.

Recently, as shown in U.S. Pat. No. 3,941,166, another approach has been taken in S-Z twisting which attains several advantages of the just described prior art methods to the exclusion of several of their disadvantages. Here, a fixed storage accumulator is employed with spaced twister heads mounted for synchronous movement about the strands which are advanced through the accumulator at a constant line speed. The twister heads are driven first in one direction about the strands and then abruptly driven in the opposite direction each time a twisted strand segment passes through the accumulator. In this manner the strands are twisted half of their final twist by the first head and the remaining half by the second head.

Though the lastly described approach offers several advantageous features it passes twist reversal points through the entire accumulator. This action renders the strands susceptible to becoming untwisted at twist reversal points in the process which is particularly true here since the strands are passed through the accumulator in only a half twisted condition. It thus would be desirable to devise yet another method of forming S-Z twists that could utilize a fixed storage type accumulator operated at a constant strand line speed without performing an untwisting operation upon the strands or passing twist reversal points through the accumulator.

SUMMARY OF THE INVENTION

In a preferred form of the present invention a method of forming strands into twisted units having a twist direction that reverses from section to section is provided wherein the strands are advanced side-by-side successively through first and second mutually spaced twister heads. The strands are formed into twisted strand units by operating the twister heads simultaneously by revolving the twister heads in a common direction about the strands at substantially the same speed of head revolution thereby causing a first progression of twists of one lay direction to pass from the first twister head towards the second twister head and a second progression of twists of opposite lay direction to emanate from the second twister head. The twisting operations of the first and second twister heads are simultaneously terminated as the leading end of the first progression of twists reaches the second twister head and a trailing end of the second progression of twists emanating therefrom. Operation of the first and second twister is then suspended until a trailing end of the first progression of twists reaches the second twister head whereupon the foregoing steps are sequentially repeated.

Other features of the invention will be readily understood from the following detailed description of specific embodiments thereof when read in conjunction with the accompanying drawing.

DESCRIPTION OF THE PREFERRED EMBODIMENTS

Figures 1, 2, 3, 4:
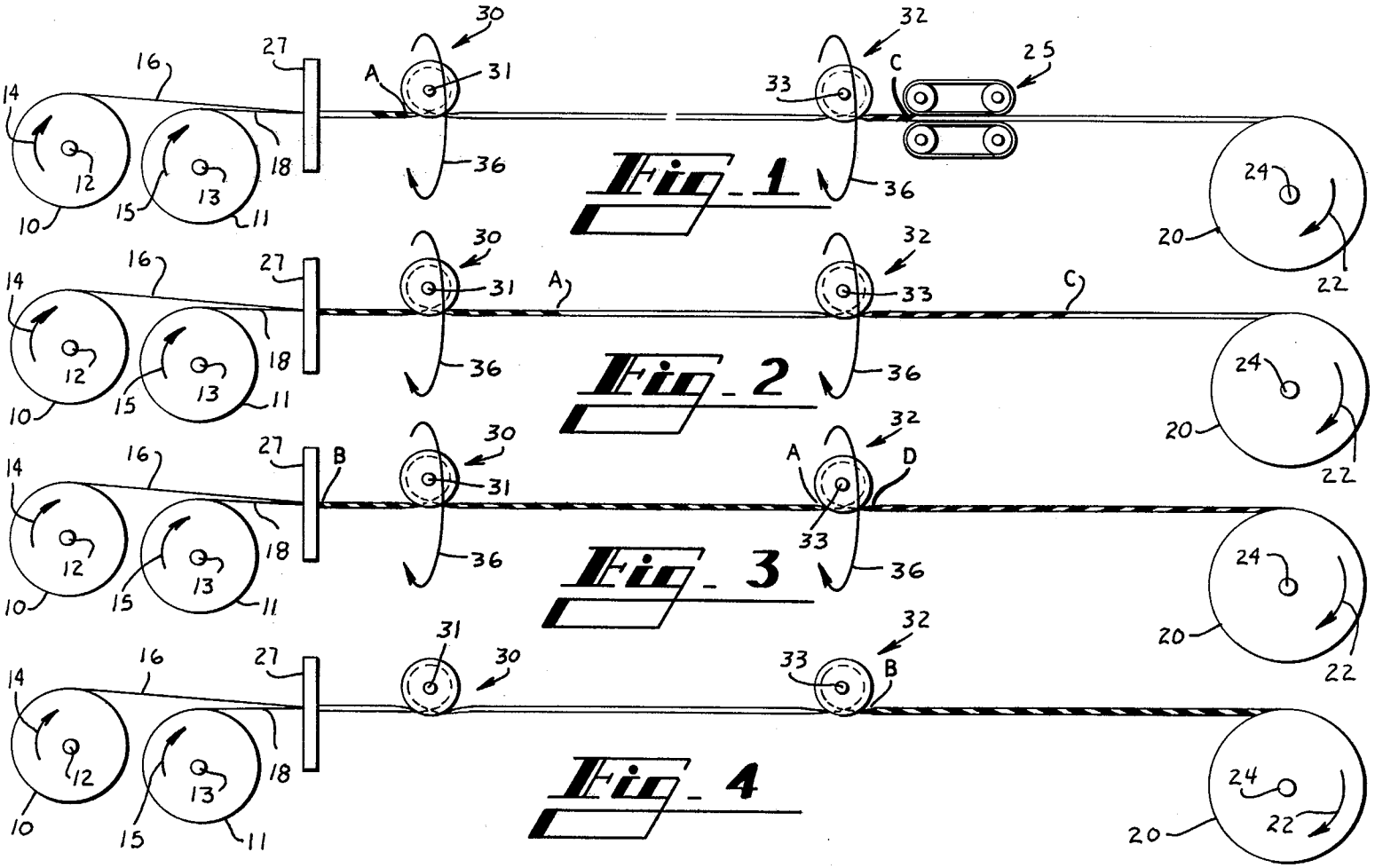
FIGS. 1–4 are schematic diagrams illustrating an initial sequence of steps taken in practicing the invention in a preferred form.

Referring now in more detail to the drawing, there is schematically illustrated conventional apparatus which may be used in practicing the invention and which includes a pair of strand supply reels 10 and 11. The supply reels are mounted for rotation about axes 12 and 13 in the direction indicated by arrows 14 and and 15 for supplying strand material 16 and 18, such as insulated electrically conductive wire, for twisting operations. Following this the strands are taken up by a takeup reel 20 mounted for rotation in direction of arrow 22 about an axis 24. The strands are conventionally pulled through the twisting apparatus by a capstan 25 which, for clarity of explanation, is only illustrated in FIG. 1 although it is employed in each of the other steps illustrated.

The strands are first pulled through a strand spreader in the form of a die 27 having two laterally spaced passageways through which the strands 16 and 18 respectively pass. From the strand spreader the strands pass side-by-side over the sheave of a first twister head 30 and then over the sheave of a second twister head 32 spaced from the first head. The twisted strands then pass through a capstan 25 and onto the takeup reel.

The twister heads 30 and 32 may be of conventional structure such as, for example, that of the type illustrated in U.S. Pat. No. 2,655,781. Preferably, they are mechanically coupled together for revolution about the strands at a common, angular speed whereby they may be driven by a common drive. Preferably too, the strands are looped once about the sheave component of each twister head for rotary movement about mutually spaced sheave axes 31 and 33 and, in addition, for revolutionary movement about the strands in effecting strand twisting as shown by arrows 36.

In practicing the present invention in one preferred form the strands are routed from the two supply reels 10 and 11 to the takeup reel 20 through the spreader die 27, the two twisting heads 30 and 32 and the capstan 25. The capstan 25 is then energized to pull the strands 16 and 18 side by side at a constant linear line speed of strand advance through the twister heads and onto the takeup reel. As this occurs, and continuing throughout the twisting operation, the twisting head sheaves rotate about their own axes 31 and 33 thereby avoiding rubbing-type contact between sheaves and strands.

To commence strand twisting the twister heads 30 and 32 are simultaneously revolved about the line advance axis of the strands in the direction of arrows 36 at a common speed of head revolution as shown in FIG. 1. As this is done that portion of the strands between the strand spreader die and the first twister head 30 commence to become twisted. Simultaneously with this twists of opposite lay direction also start to emanate from the second twister head 32 downstream of the twisters towards the takeup reel 20. Next, as shown in FIG. 2 the twists being formed by the first twister head 30 pass downstream of that head towards the second twister head with a twist A heading this first progression of twists. Simultaneously with this another or second progression of twists headed by twists C continues to proceed downstream from the second twister head 32 towards the takeup reel 20.

The twisting action of the two heads continues until the leading twists A of the first progression of twists reaches the second twisting head 32 as shown in FIG. 3. For clarity of illustration the leading twist A here is shown spaced from the trailing twist member D of the second progression emanating from the second twister 32 by the sheave wrap-around distance. In actuality however there preferably would be no gap between the two progressions.

With the two progressions now having come together with the leading end of the first progression having reached the second rotating head and trailing edge of the second progression of the twists, revolution of the two twister heads 30 and 32 about the strands is halted thereby suspending twisting operations while the linear advance speed of the strands is maintained constant. As a result the first progression of the twists between the two twisting heads is now passed downstream through the second twisting head 32 until the trailing twist member B in the first progression reaches the second twister head as shown in FIG. 4. At this time the two twister heads 30 and 32 are once again revolved about the strands to resume twisting.

Figures 5, 6, 7:
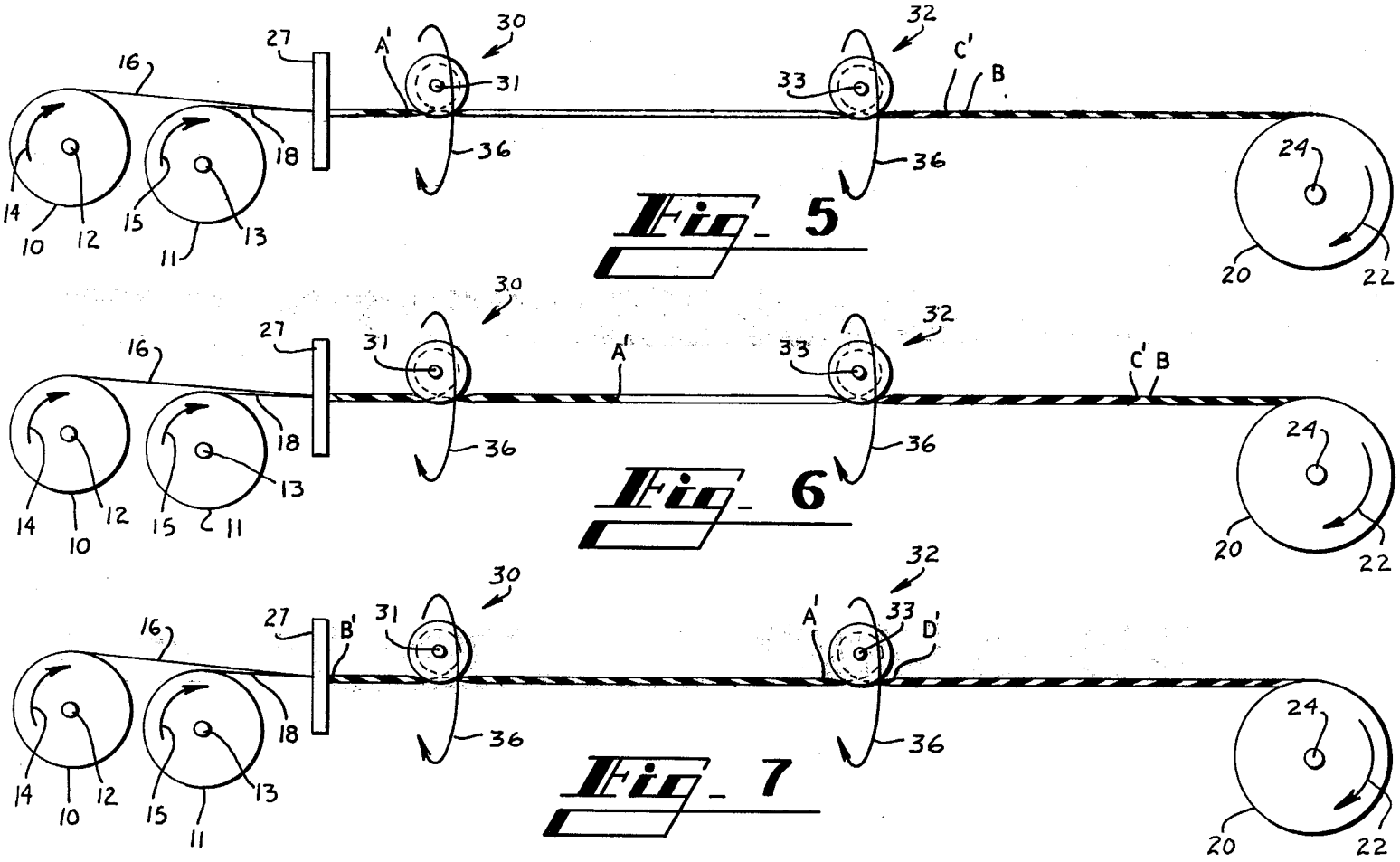
FIGS. 5–7 are schematic diagrams of steps sequentially taken following the steps shown in FIGS. 1–4 in concluding one cycle of operation.
Figures 8, 9, 10:
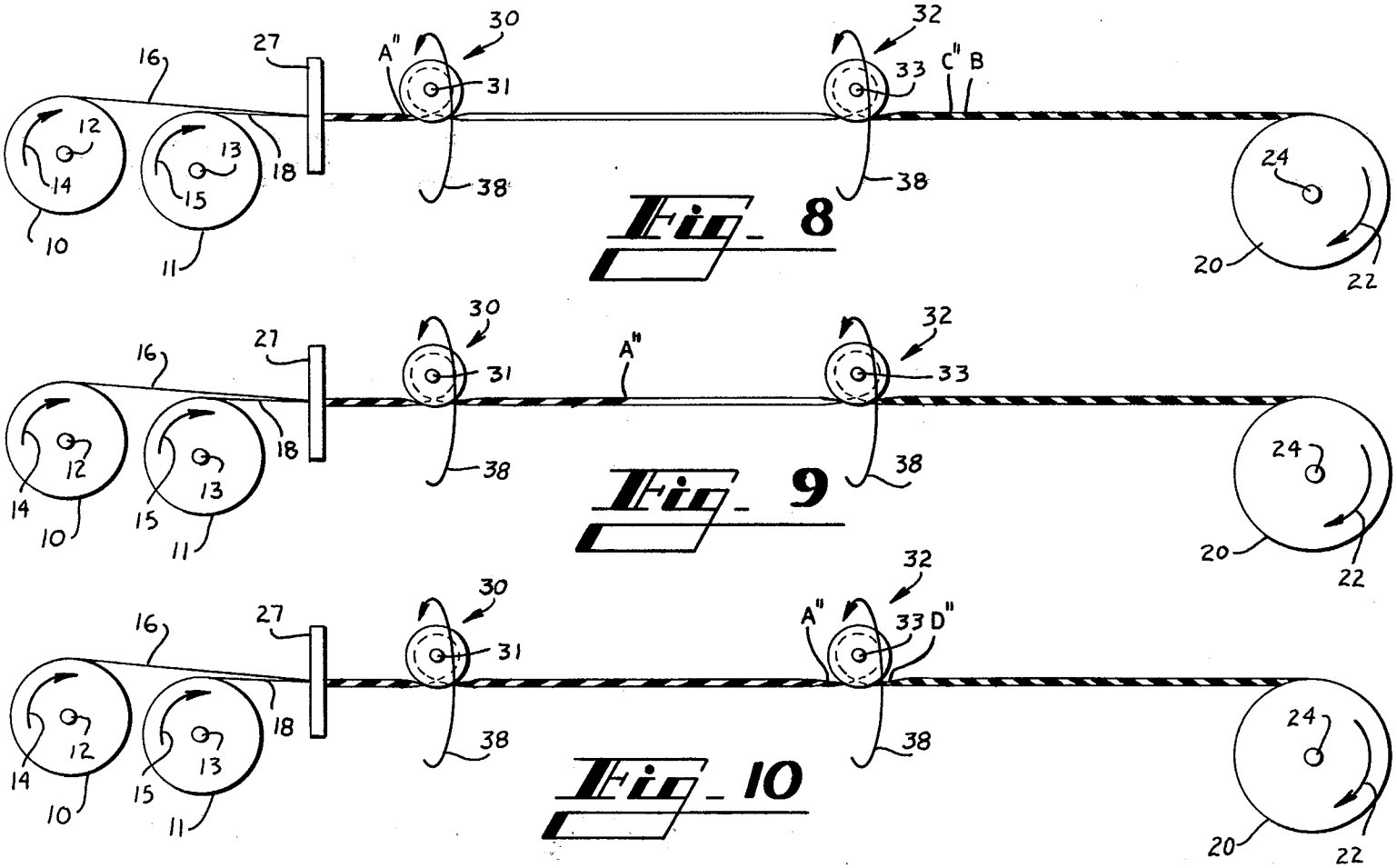
FIGS. 8–10 schematically illustrate an alternative series of steps which may be taken following those shown in FIGS. 1–4 in practicing the invention in another form.

The direction of rotation of the heads upon resumption of twisting may either be same as that of FIGS. 1–4 as shown by arrows 36 in FIGS. 5–7 or in the opposite direction indicated by arrows 38 in FIGS. 8–10. Referring first to the sequence shown in FIGS. 5–7, upon resumption of revolution of the two twister heads another or third progression of twists is formed between the first twister head 30 and strand spreader 27 lead by progression member twist A′ while a fourth progression of twists also commences to be formed by the second twister head 32 headed by member twist C′ which immediately follows the trailing twist member B of the first progression of twists as shown in FIG. 5. The revolution of the twister heads in the direction of arrows 36 is continued as shown in FIG. 6 with the third progression of twists headed by twist A′ approaching the second twister head 32 and the fourth progression of twists headed by twist C′ moves downstream from twister head 32 towards the takeup reel. This is continued until the leading twist A′ of the third progression of the twists reaches the second twister head 32 and the trailing member twists D' of the fourth progression of twists as shown in FIG. 7. At this time the revolutionary movement of the twister heads about the strands is again suspended as shown in FIG. 4 until the trailing twist B' of the third progression of twists reaches the second twister head 32. The entire process is then repeated indefinitely.

With reference next to FIGS. 8–10 it is seen that following the arrival of the trailing twist member B in the first progression of twists at the second twisting head 32 in the "pass-through" step of FIG. 4 the twister heads may again be revolved about the strands but in the opposite direction of revolution indicated by arrows 38 as shown in FIG. 8. This twisting action is continued until the leading twist member A" of the third progression of twists from the first twister head 30 reaches the second twister head 32 as shown in FIG. 10 and the trailing twist member D" of the fourth progression of twists proceeding downstream from the second twister head. At this time revolution of the twister heads is again arrested until the third progression of twists from the first twister head has passed through the second twister head as shown in FIG. 4. The entire procedure is then again repeated commencing with the step shown in FIG. 1.

It thus is seen that where the direction of twister head revolution remains the same the procedure is as sequentially shown in FIGS. 1, 2, 3, 4, 5, 6, 7, 4, 1, 2 . . . while where the direction of head revolution alternates the sequence is as successively shown in FIGS. 1, 2, 3, 4, 8, 9, 10, 4, 1, 2 . . . .

It should be noted that the direction of lay of the twists being formed by the twister heads in FIGS. 8–10 is opposite to the direction of lay of the twists being formed by the twister heads in FIGS. 5–7. Thus, as seen in FIG. 8 the lay direction of the trailing twist member B of the first progression of twists is the same as that of the leading twist member C" of the fourth progression of twists emanating from the second twister head. As a result the distance between twist reversal points achieved in alternating the direction of twister head revolution is twice that achieved by maintaining the same direction of head revolution for any given spacing of twister heads. This is desirable from both electrical and mechanical properties of the twisted strand units produced. Alternatively, this may be put to advantage by halving the spacing between the twister heads as a manufacturing space savings measure. Space savings may also be achieved, if desired, by passing the strands through the two twister heads more than once such as the manner shown in U.S. Pat. Nos. 3,643,411 and 3,808,787.

It thus is now seen that a method of forming strands into twisted strand units having a twist lay that reverses from section to section is provided which does not require the utilization of breathing accumulators or varying capacity in-line accumulators, and by which the line speed of the strands may be maintained constant without the need for ancillary accumulators interposed between the twisting and other manufacture stations. In addition, the speed of revolution of the twisting heads employed may be both the same in magnitude and direction which permits the use of a single drive mechanism for driving the twister heads.

It should further be understood that the just described embodiments merely illustrate principles of the invention in two preferred forms. Many modifications, additions and deletions may, of course, be made thereto without departure from the spirit and scope of the invention as set forth in the following claims.

What is claimed is:

1. A method of forming strands into twisted strand units having a twist direction that reverses from section to section wherein the strands are advanced side by side successively through first and second mutually spaced twister heads and are formed into twisted strand units by the steps of:

(a) operating the twister heads by simultaneously revolving the twister heads in a common direction about the strands at substantially the same speed of head revolution thereby causing a first progression of twists of one direction to pass from the first twister head towards the second twister head and a second progression of twists of opposite direction to emanate from the second twister head;

(b) simultaneously terminating twisting operations of the first and second twister heads by terminating their revolutionary movement about the strands by reduction in the revolutionary speed of the twister heads as the leading end of the first progression of twists reaches the second twister head and a trailing end of the second progression of twists emanating therefrom;

(c) suspending twisting operations of the first and second twister heads until a trailing end of the first progression of twists reaches the second twister head; and (d) sequentially repeating steps (a), (b), and (c).

2. A method of forming strands into twisted strand units in accordance with claim 1 wherein the strands are successively advanced at a constant linear speed through the first and second twister heads during steps (a), (b), (c), and (d).

3. A method of forming strands into twisted strand units in accordance with claim 1 wherein the spacing between the first and second twister heads is maintained constant during steps (a), (b), (c), and (d).

4. A method of forming strands into twisted strand units in accordance with claim 1, 2, or 3 wherein successive steps (a) the twister heads are revolved about the strands in the same common direction.

5. A method of forming strands into twisted strand units in accordance with claim 1, 2, or 3 wherein successive steps (a) the twister heads are revolved about the strands in reverse common directions.

6. A method of forming strands into twisted strand units in accordance with claim 1 wherein the strands are advanced through a twist progression limiting strand spreader prior to advancement through the first twister head.

7. A method of forming strands into twisted strand units in accordance with claim 1 wherein the strands are successively advanced through first and second twister heads of a type comprising a sheave mounted for rotary movement about an axis oriented transverse the direction of strand advance and also for revolution about the strands in performing strand twisting operations.

8. A method of forming strands into twisted strand units having a twist direction that reverses from section to section wherein the strands are advanced side by side successively through first and second mutually spaced twister heads and are formed into twisted strand units by the steps of:

(a) operating the twister heads by simultaneously revolving the twister heads in one common direction about the strands at substantially the same speed of head revolution thereby causing a first progression of twists of one direction to pass from the first twister head towards the second twister head and a second progression of twists of opposite direction to eminate from the second twister head;

(b) simultaneously terminating twisting operations of the first and second twister heads on the strands as the leading end of the first progression of twists reaches the second twister head and a trailing end of the second progression of twists eminating therefrom;

(c) suspending twisting operations of the first and second twister heads until a trailing end of the first progression of twists reaches the second twister head;

(d) again operating the twister heads by simultaneously revolving the twister heads in another common direction opposite said one common direction about the strands at substantially the same speed of head revolution thereby causing a third progression of twists of said opposite direction to pass from the first twister head towards the second twister head and a fourth progression of twists of said one direction to eminate from the second twister heads;

(e) simultaneously terminating twisting operations of the first and second twister heads on the strands as the leading end of the third progression of twists reaches the second twister head and a trailing end of the fourth progression of twists eminating therefrom; and (f) suspending operation of the first and second twister heads until a trailing end of the third progression of twists reaches the second twister head.

* * * * *